US005462515A

United States Patent [19]

Tseng

[11] Patent Number: 5,462,515

[45] Date of Patent: Oct. 31, 1995

[54] MULTI-FUNCTIONAL AUTOMATIC CIRCULAR MASSAGING DEVICE

[76] Inventor: Chin-Tsun Tseng, No. 13, Lane 380, Sec. 2, Chung-Shan Rd., Chung-Ho City, Taipei Hsian, Taiwan

[21] Appl. No.: 171,216

[22] Filed: Dec. 21, 1993

[51] Int. Cl.[6] ..... A61H 1/00

[52] U.S. Cl. ..... 601/57; 601/56; 601/49; 5/915

[58] Field of Search ..... 601/15, 46, 49, 601/56, 57, 66, 58–61; 297/452.42, 452.45; 5/481, 653, 901, 903, 915, 925

[56] References Cited

U.S. PATENT DOCUMENTS

| | | | |
|---|---|---|---|
| 3,064,642 | 11/1962 | Stewart | 601/60 |
| 3,446,204 | 5/1969 | Murphy | 601/57 |
| 3,885,553 | 5/1975 | Vecchio | 601/57 X |
| 4,005,703 | 2/1977 | Rosen et al. | 601/57 |
| 4,052,981 | 10/1977 | Buchmann | 601/60 |
| 4,465,158 | 8/1984 | Yamazaki et al. | 601/57 X |
| 4,570,616 | 2/1986 | Kunt et al. | 601/57 X |
| 5,020,517 | 6/1991 | Foster, Jr. et al. | 601/57 |
| 5,022,384 | 6/1991 | Freels et al. | 601/57 |
| 5,181,504 | 1/1993 | Ono et al. | 601/57 X |
| 5,188,096 | 2/1993 | Yoo | 601/57 |

FOREIGN PATENT DOCUMENTS

| | | | |
|---|---|---|---|
| 2132741 | 1/1973 | Germany | 297/445.45 |
| 416248 | 9/1934 | United Kingdom | 601/57 |
| 2241894 | 9/1991 | United Kingdom | 601/57 |
| 2256147 | 12/1992 | United Kingdom | 601/57 |

*Primary Examiner*—Robert A. Hafer
*Assistant Examiner*—Brian E. Hanlon
*Attorney, Agent, or Firm*—Thomas M. Freiburger

[57] ABSTRACT

A multi-functional automatic circular massaging device including at least a pair of motors respectively disposed in a pair of housings to rotatively drive cams for creating a vibrating massaging effect, a soft pad formed with two lateral recesses for receiving the housings, a heating coil sandwiched between two layers of unwoven fabrics, a surface layer covering the soft pad, and a controlling box connected to the motors and an external power source. The surface layer is formed with alternating X-shaped protuberances and spherical bosses and alternating long and short rod-like protuberances disposed on four side edges of the surface layer. The controlling box includes a circuit board having a specific chip which controls the motors to output varying power at a predetermined time interval, creating sequential automatic circularly varying at least eight stages of massaging effect from strongest stage to weakest stage. A setting key of the controlling box is used to vary and fix the time interval for each of the eight stages. A heating key is used to activate the heating coil for creating heating effect. The massaging device is suitable to be disposed in both back cushion and seat cushion of a seat.

1 Claim, 6 Drawing Sheets

MULTI-FUNCTIONAL AUTOMATIC CIRCULAR MASSAGING DEVICE

BACKGROUND OF THE INVENTION

The present invention relates to a multi-functional automatic circular massaging device, and more particularly to a massaging device which automatically creates multi-stage variation of massaging effect.

A conventional massaging device usually includes a single motor for creating simple vibration to achieve the massaging effect. Such device can hardly actually improve the health of the user. An inflatable back cushion equipped with a pair of motors to create stronger vibration has been developed to achieve a better massaging effect. Also, many kinds of massaging chairs are used to massage a user or a patient. These massaging devices are composed of numerous parts and thus the prices thereof are relatively high. Therefore, such massaging devices are suitable to serve as rehabilitation equipments and cannot be widely used by general persons.

Therefore, it is necessary to provide a massaging device which possesses multiple functions and can be conveniently used by general persons to create optimal massaging effect.

SUMMARY OF THE INVENTION

It is a primary object of the present invention to provide a multi-functional automatic circular massaging device including at least a pair of motors respectively disposed in a pair of housings to rotatively drive cam means for creating a vibrating massaging effect. A surface layer of the massaging device is formed with alternating X-shaped protuberances and spherical bosses corresponding to the vital points of human body. The massaging device is controlled by a controlling box including a circuit board having a specific chip which controls the motors to output varying power at a predetermined time interval, creating sequential automatic circularly varying at least eight stages of massaging effect from strongest stage to weakest stage so as to simulate the finger pressing massaging effect.

It is a further object of the present invention to provide the above massaging device, wherein the circuit board includes a means for controlling each output time variation. This means is connected with a variable resistor, an adjusting switch and a cooperative capacitor to control the charging/discharging of the capacitor so as to achieve the eight stages of variation. When when the adjusting switch is adjusted to a desirable time interval, a setting key of the controlling box is pressed down to fix the time interval for each of the eight stages of variation. When no time period is set, the eight stages interchangingly last for a minimum time period, whereby the time period of each stage of variation is optionally different to achieve an optimal using state.

It is still a further object of the present invention to provide the above massaging device, wherein a heating plate is disposed above the housing of the motors, whereby when pressing down a heating key of the controlling box, the heating plate is heated and the temperature thereof ascends to about 45 Celsius degrees. Thereafter, a temperature controller automatically shuts off the power and after the temperature is lowered, the heating plate is again activated to create heating effect on specific portions of human body and enhance circulation thereof as well as avoid accumulation of water and enhance ventilation of air.

It is still a further object of the present invention to provide the above massaging device, wherein the massaging device can be directly applied to the back cushion and seat cushion of a seat, such as a sofa, an office chair, a leisure chair and especially a car seat or a bed.

It is still a further object of the present invention to provide the above massaging device, wherein the massaging device is disposed in a back cushion and a middle convex portion is formed on the back cushion. The motors are disposed on two sides of the middle convex portion. The back cushion with the massaging device can be freely placed on a seat back to massage the user's back or directly placed on the user's body to massage different portions thereof, such as the head, chest, abdomen, neck, back, waist, thigh, leg, sole, palm, hand back, etc. The protuberances of the present invention serve to recover the user from tiring, enhance the circulation of blood, relieve the pain of muscle or nerve and rehabilitate the injured portion of human body. Moreover, the present invention can be applied to a car seat to make the driver and passengers all comfortably sit on the seats to concentratively drive the car for insuring the driving safety.

It is still a further object of the present invention to provide the above massaging device, wherein the back cushion of the present invention has a back surface formed with slideproof crossing stripes so as to facilitate the location of the back cushion.

The present invention can be best understood through the following description and accompanying drawing, wherein:

DETAILED DESCRIPTION OF THE PREFERRED EMBODIMENTS

Figure 1:
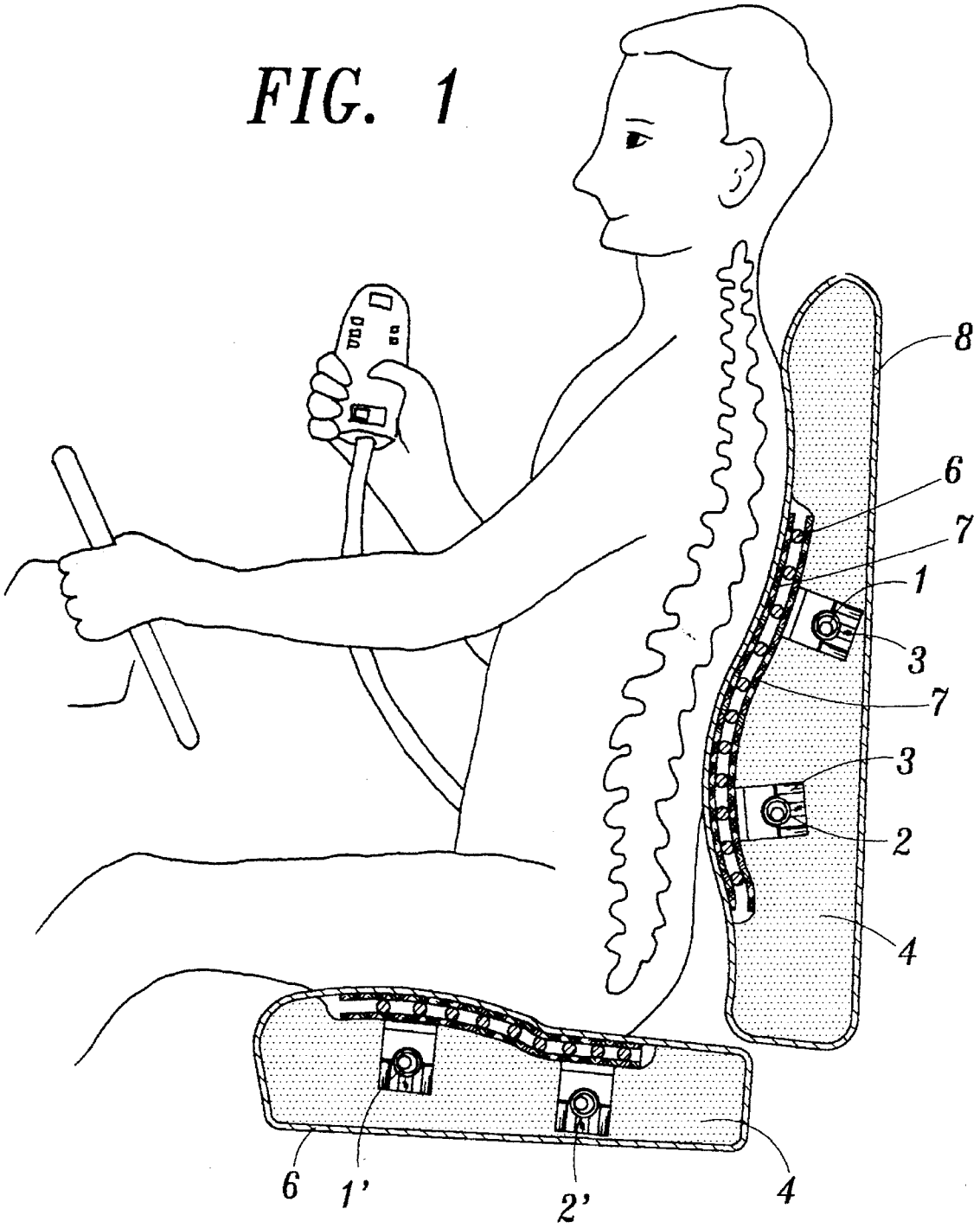
FIG. 1 is a sectional view of the present invention applied to a seat.
Figure 5:
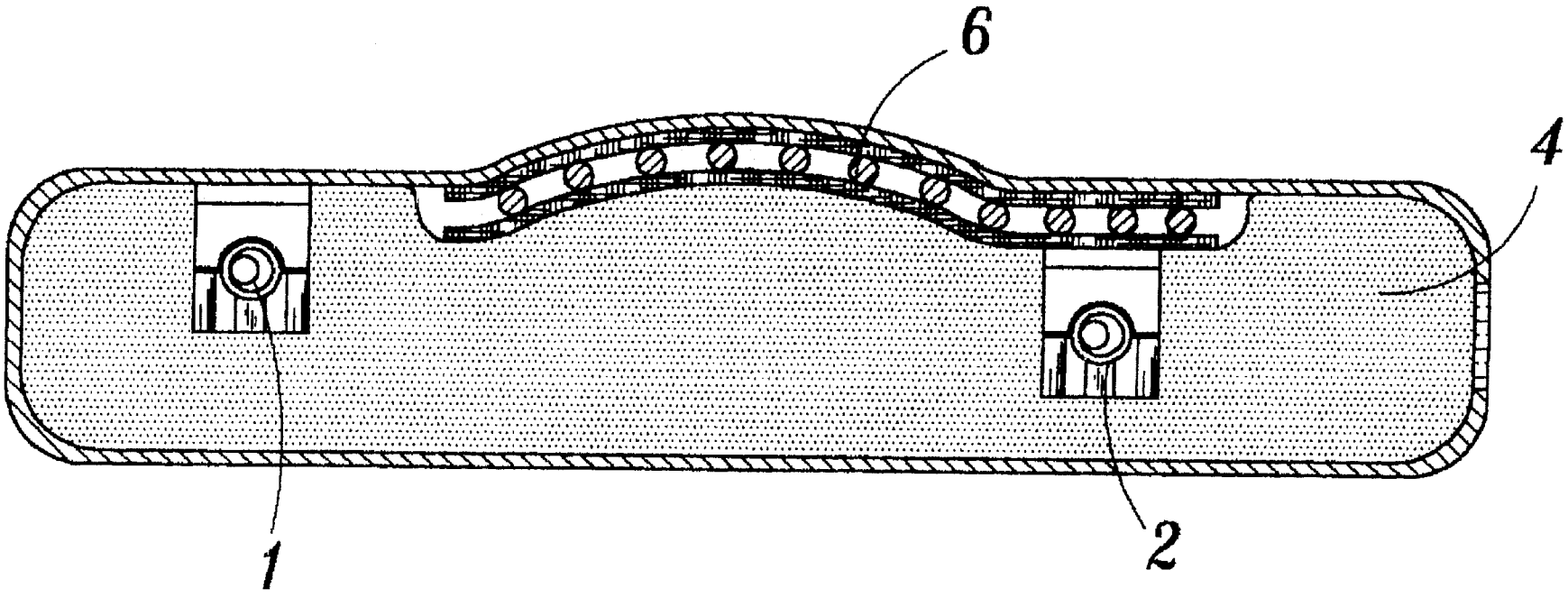
FIG. 5 is a sectional view of the back cushion including the present invention.

Please refer to FIGS. 1 and 5. The massaging device of the present invention includes at least a pair of motors 1, 2 respectively disposed in a pair of housings 3 to rotatively drive cam means for creating a vibrating massaging effect, a soft pad 4 formed with a middle bulge portion and two lateral recesses 5 for receiving the housings 3, a heating coil 6 sandwiched between two layers of unwoven fabrics 7 and disposed above the motors 1, 2, a surface layer 8 covering the soft pad 4, and a controlling box 9 connected to the motors 1, 2, the coil 6 and an external power source 10. The housing 3 has an upper cap 31 with outward extending edges so as to facilitate the installation of the housings 3. The surface layer 8 is formed with alternating X-shaped protuberances 81 and spherical bosses 82. In addition, alternating long and short rod-like protuberances 83, 84 are formed on four side edges of the surface layer 8. The controlling box 9 is provided with a switch 92 for turning on/off the power, a circuit board 91, a massaging key 93 for activating the circuit board 91 to control the two motors 1, 2 for creating automatic circularly changing eight stages of massaging effects, including strongest, very strong, middle strong, strong, weak, middle weak, very weak and weakest stages, an eight-stage switch 94 for varying the time period of each of the eight stages, a fixing key 95 for fixing the time period of the eight stages. When no time period is set, the eight stages will interchangingly last for a minimum time period, and a heating switch 96 for activating the heating coil 6.

Figure 2:
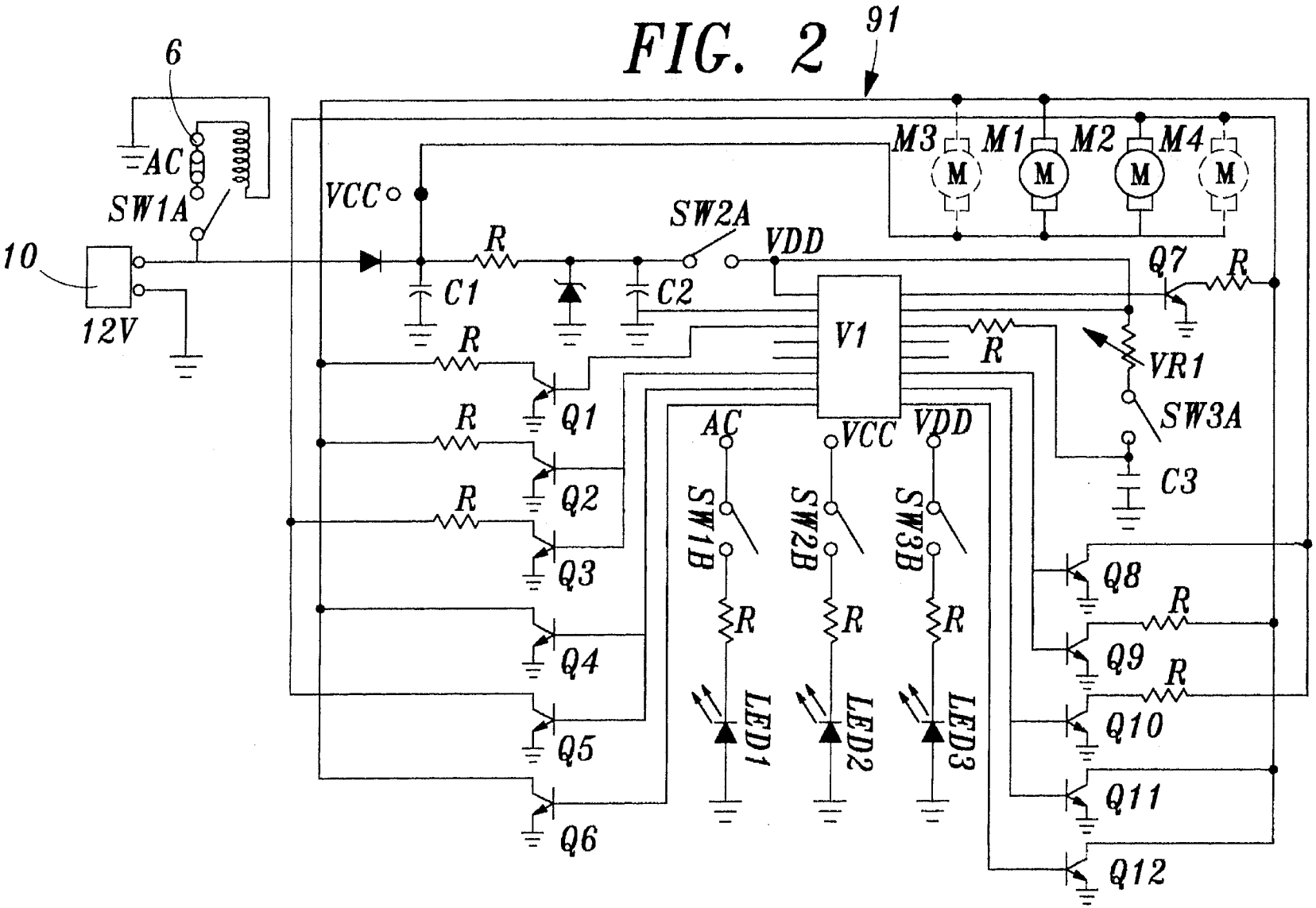
FIG. 2 is a circuit diagram of the present invention.

Referring to FIG. 2, the power for the present invention is preferably 12 V power. However, the 110 V or 220 V power can be transformed to serve as the power. A switch SW1A is used to control the turning on/off of the present invention. The input power is distributed to the heating coil 6 and moters M1, M2 (1, 2). The circuit board 91 is provided with a specific chip V1 for controlling the working of two sets of transistors, including motor M1 and transistors Q1, Q2, Q4, Q6, Q8, Q10, and motor M2 and transistors Q3, Q5, Q7, Q9, Q11, Q12. As a result, the two sets of transistors can cooperate with different values of resistors R for creating a series of variations, wherein for the strongest stage, the motors M1, M2 both strongly rotate, for the very strong stage, motor M1 strongly rotates, while motor M2 does not rotate, for the middle strong stage, motor M1 does not rotate, while motor M2 strongly rotates, for strong stage, motor M1 weakly rotates, while motor M2 strongly rotates, for weak stage, motor M1 strongly rotates, while motor M2 weakly rotates, for middle weak stage, motor M1 does not rotate, while motor M2 weakly rotates, for very weak stage, motor M1 weakly rotates, while motor M2 does not rotates, and for the weakest stage, motors M1 and M2 both weakly rotate. Therefore, basically, the two motors have slightly different powers. However, two pairs of motors can be connected in series to achieve the same variation. Alternatively, 16 stages of variation can be performed by changing the time sequence. A variable resistor VR1 and a cooperative capacitor C3 are connected to the chip V1 for determining the charging time. The switch SW3A (94) is used to control the time period. In this embodiment of the present invention, eight stages of variation is achieved. The time unit for variation is set to be a fraction of one second. The switch SW2A is used to control whether the heating should be performed. A temperature controller is disposed, whereby when the temperature is too high over a set value, the power is cut and after the temperature is lowered, the power is again supplied to heat the coil 6. The switches SW1B, SW2B, SW3B control the turning on/off of three light emitting diodes LED1, LED2, LED3 to indicate and facilitate the panel operation of the controlling box 9 and avoid mis-operation. The switches are all film-typed so that the operation thereof is easy and the touching feeling thereof is better and the operation speed thereof is faster. As shown by phantom lines in FIG. 2, the motor M1 can be parallelly connected with a motor M3 (1') and the motor M2 can be parallelly connected with a motor M4 (2') and as shown in FIG. 1, another controlling box 9 is used to control the motors 1', 2'.

The massaging device of the present invention is characterized by the automatic circularly varying massaging effect and the controlling of the circulation time change. The X-shaped and spheric protuberances on the surface layer of the massaging device are vibrated in a multi-stage manner by means of a controlling circuit which controls the multi-stage variation of output of the pairs of motors in a predetermined time period. Moreover, after the massaging key is pressed down, the massaging device immediately automatically output at least eight stages of variation of vibration strength in sequence. The massaging effect is substantially similar to the varying finger pressing massaging effect.

Figure 3:
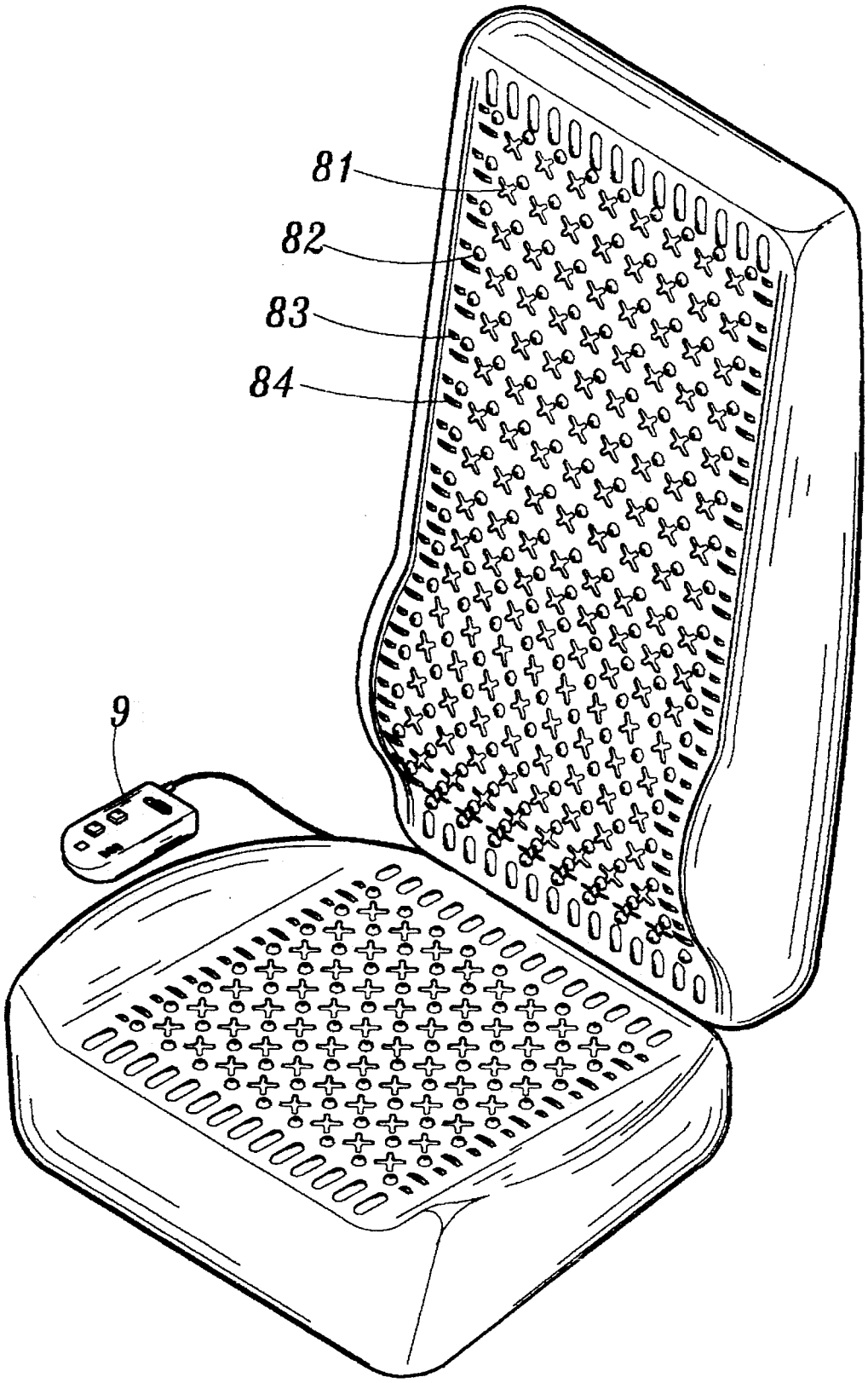
FIG. 3 is a perspective view of the seat including the present invention.

The X-shaped and spheric protuberances 81, 82 are formed on the surface layer 8 corresponding to the vital points beside the human spine as shown in FIG. 3. The present invention can be directly applied to the back cushion and seat cushion of a seat, such as a sofa, an office chair, a leisure chair and especially a car seat or a bed. Therefore, when a user sits on such a seat with his/her back closely leaning on the back cushion, the protuberances create the massaging effect similar to finger pressing massaging effect on the vital points of the user to eliminate the tired feeling. For example, when the present invention is applied to an office chair, the user can be relaxed to work in a comfortable condition for a long time. Also, the spaces between the protuberances permit air to flow therethrough and thus the sweat or heat discharged from the user will be dissipated without accumulation. The present invention can be solely disposed in the back cushion or in both the back cushion and seat cushion to massage both the back and thighs. In addition, as to the seat that has a neck portion, the present invention can be also disposed therein to massage the neck of the user. When the present invention is applied to a car seat, the driver and passengers can all comfortably sit on the seats to concentratively drive the car for insuring the driving safety. Furthermore, the protuberances of the present invention help in increasing the frictional force to keep the driver stably sit on the seat when turning the car. The present invention possesses many advantages while occupying little room.

Figure 4:
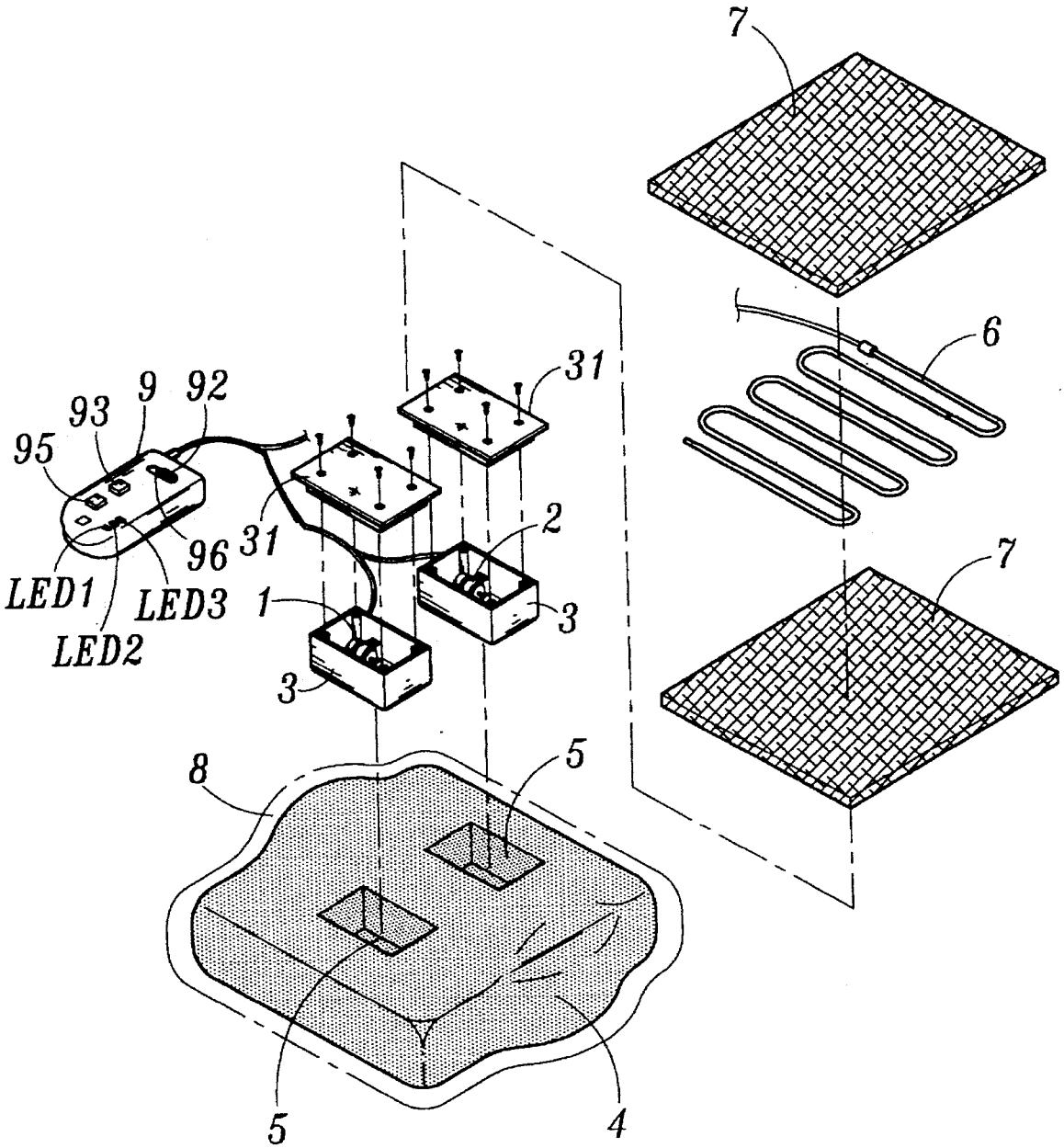
FIG. 4 is a perspective exploded view of the back cushion including the present invention.
Figure 6:
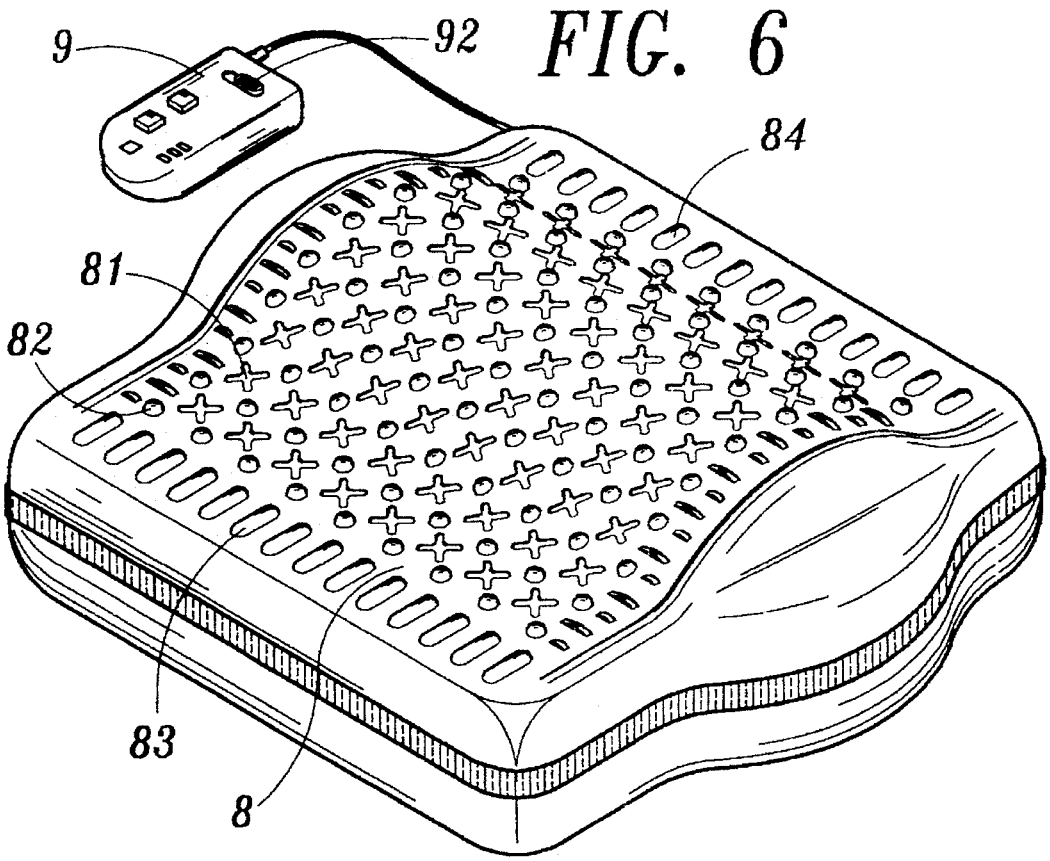
FIG. 6 is a front perspective view of the back cushion including the present invention.
Figure 7:
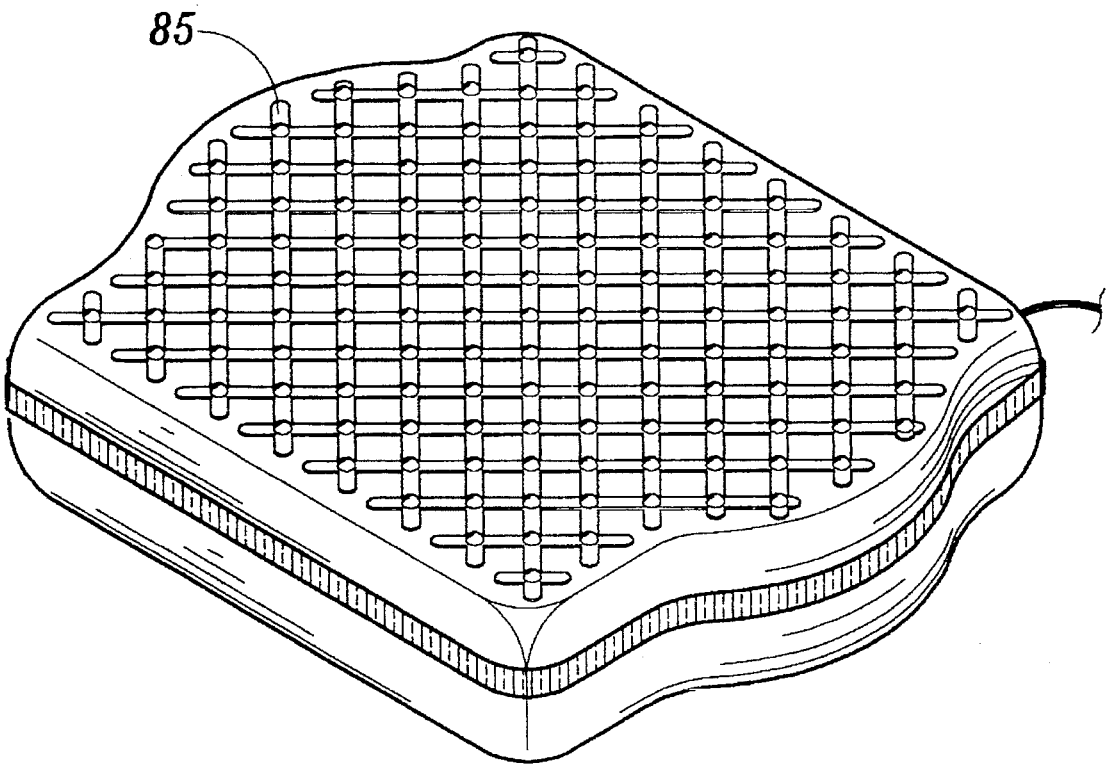
FIG. 7 is a rear perspective view of the back cushion including the present invention.

As shown in FIGS. 4 to 7, the present invention can be alternatively manufactured into a back cushion-like pattern. As shown in FIG. 4, the structure thereof is similar to that of FIGS. 1 to 3. As shown in FIG. 6, the the cushion has a small rectangular shape. Referring to FIG. 5, the upper surface of the cushion is substantially the same as that of the above described device and a middle convex portion is formed on the cushion. On two sides of the middle convex portion are disposed at least one set of motors. On the back surface of the cushion is formed slideproof crossing stripes 85 and protuberances to facilitate the location of the cushion as shown in FIG. 7.

According to the above arrangements, the massaging device of the present invention can be freely placed on various places or directly placed on the user's body to massage different portions thereof, such as the head, chest, abdomen, neck, back, waist, thigh, leg, sole, palm, hand back, etc. The present invention serves to recover the user from tiring, enhance the circulation of blood, relieve the pain of muscle or nerve and rehabilitate the injured portion of human body.

It is to be understood that the above description and drawings are only used for illustrating one embodiment of the present invention, not intended to limit the scope thereof. Any variation and derivation from the above description and drawings should be included in the scope of the present invention.

What is claimed is:

1. An automatic massaging device for a back pad, comprising a plurality of motors, each said motor driving a rotating cam means for creating a vibrating massaging effect, each said motor and respective cam means being disposed in a separate housing, a soft pad formed with a plurality of separate lateral recesses each recess receiving one of said housings, a surface layer covering said soft pad, and a controlling box connected to said motors and an external power source, wherein each of said housings has an upper cap with outward extending edges so as to facilitate the installation of said housings in the soft pad, said surface layer having front and back surfaces, said front surface formed with a plurality of alternating X-shaped protuberances and spherical bosses and said back surface formed with slide-proof crossing strips, said controlling box containing a circuit board, which independently controls the speed at which each motor rotates, with means for rotating each motor independently at a plurality of speeds including off, slow rotation, and fast rotation speeds so that each said motor is able to simultaneously operate at different speeds such that by operating the motors at the same time at the said plurality of speeds, a number of different vibration intensity levels are achieved, and means for achieving periodically cycling vibration massage intensity levels by operating the said automatic massaging device at each of the said vibration intensity levels for a short and equal duration of time, repetitively cycling between the weakest and the strongest intensity levels.

* * * * *